US007823599B2

(12) United States Patent
Thibodeau et al.

(10) Patent No.: US 7,823,599 B2
(45) Date of Patent: Nov. 2, 2010

(54) FLEXIBLE CANE FOOT

(76) Inventors: Michael R. Thibodeau, 3807A Biltmore Dr., Panama City Beach, FL (US) 32408; Phyllis Fowhand, 3807A Biltmore Dr., Panama City Beach, FL (US) 32408

( * ) Notice: Subject to any disclaimer, the term of this patent is extended or adjusted under 35 U.S.C. 154(b) by 8 days.

(21) Appl. No.: 12/055,734

(22) Filed: Mar. 26, 2008

(65) Prior Publication Data

US 2009/0242008 A1 Oct. 1, 2009

(51) Int. Cl.
*A45B 1/00* (2006.01)
*A45B 9/04* (2006.01)

(52) U.S. Cl. ..... 135/84; 248/625

(58) Field of Classification Search ..... 135/77, 135/84, 82, 86, 65; 248/188.8, 188.9, 615, 248/625

See application file for complete search history.

(56) References Cited

U.S. PATENT DOCUMENTS

| | | | | | |
|---|---|---|---|---|---|
| 834,205 | A * | 10/1906 | Jones | 135/68 |
| 1,290,159 | A * | 1/1919 | Foster | 248/615 |
| 2,449,509 | A * | 9/1948 | Richards | 135/80 |
| 4,141,375 | A * | 2/1979 | Tykwinski | 135/66 |
| 4,366,981 | A * | 1/1983 | Ziegler et al. | 297/328 |
| 4,411,284 | A | 10/1983 | Opitz | |
| 4,510,957 | A * | 4/1985 | Frank | 135/84 |
| 4,687,131 | A * | 8/1987 | von Braunhut | 135/77 |
| 4,932,719 | A * | 6/1990 | Gonzalez y. Rojas | 297/338 |
| 5,699,819 | A | 12/1997 | Simons | |
| 6,086,028 | A * | 7/2000 | Pfister | 248/188.8 |
| 6,550,490 | B1 * | 4/2003 | Morton et al. | 135/66 |
| 6,883,530 | B2 * | 4/2005 | Kawakami | 135/84 |
| 7,261,113 | B2 * | 8/2007 | Tartaglia | 135/66 |
| 2002/0091047 | A1 * | 7/2002 | Olstad | 482/123 |

FOREIGN PATENT DOCUMENTS

| | | | |
|---|---|---|---|
| DE | 8320701 UU1 | * | 12/1984 |
| DE | 4108834 A1 | * | 9/1992 |

* cited by examiner

*Primary Examiner*—David Dunn
*Assistant Examiner*—Tania Abraham
(74) *Attorney, Agent, or Firm*—Daniels Patent Law PLLC; Scott A. Daniels

(57) ABSTRACT

An ambulatory support and traction device used as a flexible foot (1) added to a walking aid, such as a cane or crutch (6), is provided. The flexible foot (1) includes a bendable coil or spring (3) that allows angulation of a walking aid shaft (4) relative to the foot (1) without the loss of adherence of the foot to a ground surface (19). The allowance of angulation of the walking aid shaft (4) improves ambulatory support and balance when leaning on the walking aid or when traversing an inclined surface and can assist the user in rising from a sitting position to a standing position without repositioning of the foot. The flexible foot (1) has a rigid base (2) for structural support and a traction sole (17) to adhere to surfaces both indoors and outdoors and on different surfaces and environments.

13 Claims, 5 Drawing Sheets

FLEXIBLE CANE FOOT

FIELD OF THE INVENTION

The present invention relates to an accessory for walking aids such as a cane or a crutch whereby the accessory provides for a stable footing or base support for the cane or crutch during ambulatory movement of the user particularly where the cane or crutch is angled relative to a ground or supporting surface. More particularly, the accessory is a flexible, spring biased foot which is attached to the end of the walking aid and is permitted a 360 degree angulation relative to the supporting surface or ground.

BACKGROUND OF THE DISCLOSURE

Walking aids in the form of staffs, canes and crutches are well known and have been available in many varieties to accommodate a person's need of support and ambulation. Also known are a variety of modifications and accessories to these aids to ergonomically improve the comfort, safety and use of such aids by the addition of handles or arm support designs or to provide grip or stability on a ground surface. Common designs to assist in the ambulatory support of a user leaning on the walking aid are to add platforms or multiple legs to the ground engaging end of the walking aid to give stability to the user.

These designs generally require that the walking aid and the relative shaft be maintained substantially perpendicular to the ground surface so that there is full contact of the platform or multiple legs. If there is only partial or angular contact of the ground engaging end of the walking aid with the ground surface stability is compromised. Clearly where a ground engaging end of a walking aid is not in complete contact with the ground surface the chances for the walking aid to slide, slip or move without warning is substantially increased possibly causing injury to the user. Although rubber end caps or tips are often provided at the ground engaging end of such walking aids and may by their malleable nature assist in establishing sufficient friction and stability, they not only wear inconsistently due to such use but are only a partial solution where the base of the walking aid is still not planarly aligned with the ground surface.

There are numerous impact cushioning devices known in the prior art for example U.S. Pat. No. 5,699,819. The known impact cushioning devices are however, just that, cushioning devices intended to merely vertically absorb the impact of the cane or other walking aid on the ground surface. The '819 patent reference includes a cane having an end, and a spring within a connecting sleeve disposed around the cane end where the spring is connected from between a lower end of the cane to an inner cavity of the rubber spring tip. The rubber tip is fitted snugly so as to only slide axially up and down around the collar of the connecting sleeve such that the spring is maintained axially aligned with the cane shaft in a compression and extension function only.

Other designs incorporate pointed tips or grippers to use the walking aid on uneven or slippery surfaces, but these usually require the user to remove or disengage in some manner the sharpened points when using the aid indoors as in U.S. Pat. No. 4,411,284. Other devices include a complex combination of various means, expensive to manufacture and produce and less that positive in their action to provide the intended benefits. Such devices formed of a multiplicity of parts are difficult to manufacture, assemble, adjust, maneuver or operate, and are basically difficult or impractical to convert from indoor to outdoor use without great effort and manipulation by the user.

While these devices fulfill their respective, particular objectives and requirements, the aforementioned patents do no disclose an accessory for a walking aid which provides cushioning and reduced impact as well as angulation where the foot or base of the accessory is maintained in a planar relationship with the supporting ground surface. In this; regard where the foot or base of the free end of the walking aid can be maintained in a parallel planar relationship with the ground supporting surface, no matter at what angle the walking aid is inclined relative to the supporting surface, the more traction and stability is imparted to the walking aid and hence the user.

OBJECTS AND SUMMARY OF THE INVENTION

The present disclosure is directed towards an easy and economical solution to ambulatory support and traction for a walking aid such as a cane or a crutch. This disclosure describes a cane foot fabricated from a coil and a substantially planar base where the coil defines a bore into which is inserted a shaft of a walking aid such as a cane or a crutch. At one end of the coil the base is secured thereto by any means known in the art to provide a ground engaging surface. The coil thus partially surrounds or encompasses a lower end portion of the shaft of the walking aid and is frictionally or torsionally secured thereto by the natural torsion strength of the coil. The base having a planar bottom surface now directly engages the ground engaging surface rather than the extreme end of the shaft about which the coil is engaged. The foot may be added as a modification to the walking aid after, or during manufacturing.

Because the base is connected only to the coil, the coil permits axial, radial and angular flexibility between the base and the vertical axis of the shaft of the walking aid. For example on an inclined or uneven surface the user may maintain the shaft of the walking aid in a substantially vertical i.e. straight up and down alignment, however the angular flexibility of the coil permits the base to planarly match the inclined or uneven surface upon which the foot is resting. Similarly, where the user is on substantially horizontal ground and for some reason the walking aid is at a non-perpendicular angle thereto, the coil permits the base to remain in complete parallel planar contact with the supporting surface despite the angulation of the shaft with the supporting surface and the user can readily maintain balance even when moving the shaft of the walking aid in angulation while maintaining pressure to the foot that remains in a stable position adhered to the supporting ground surface.

It is an object of the present invention to provide a foot for a walking aid such as a cane or a crutch having increased stability and improved traction in various environments and ground surfaces.

It is another object of the invention to manufacture an inexpensive device for increasing the traction of a walking aid on an inclined surface and which can be retrofitted to almost any known cane or crutch.

It is still another object of the invention to provide an axially, radially and angularly flexible foot moveable relative to the shaft of the cane or crutch to which the foot is attached.

It is a still further object of the present invention to form the foot having a rigid base fabricated of metal or similarly rigid material that is of an adequate thickness to not deform or deflect under load or pressure; and a friction sole made of rubber or other known non-slip material attached to one side of the base providing friction and traction between the base and the ground surface.

Another object of the present invention is to attach a coil or spring to the side of the base opposite the friction sole which facilitates connection of the foot directly to an end of the cane or crutch and which spring or coil has a spring coefficient which permits relative angular, axial and radial displacement of the base relative to the cane or crutch.

This flexible foot is an elegant, safe, practical and cost effective device for use as an accessory and improvement to a walking aid such as a cane or a crutch. The flexible foot is capable of integrating with pre-existing walking aid designs and improve ambulatory support and traction to better accommodate these designs for use in various surfaces and in different environments. The foot may be used indoors or outdoors, on different surfaces without the added nuisance or complexity of removal, adjustment or control by the user.

The present invention relates to a walking aid for facilitating movement of a human user comprising a handle for manual articulation and operation of the walking aid by the user, a shaft extending along a longitudinal axis between the handle and a free end of the shaft generally positioned adjacent a supporting ground surface, a flexible foot attached to the free end of the shaft, the flexible foot comprising a spring having a first end and a second end defining a bore therebetween for receiving a portion of the shaft of the walking aid within the bore, a substantially planar base having a top surface attached to the first end of the spring and a bottom surface having a traction sole affixed thereto, and wherein the shaft is retained in attachment to the flexible foot by torsional force exerted by the spring on the received portion of the shaft and the entire planar base is angularly moveable relative to the longitudinal axis of the shaft.

The present invention also relates to a method for facilitating movement of a human user comprising the steps of providing a handle for manual articulation and operation of the walking aid by the user, forming a shaft extending along a longitudinal axis between the handle and a free end of the shaft generally positioned adjacent a supporting ground surface, attaching a flexible foot to the free end of the shaft according to the following steps, providing a spring having a first end and a second end defining at bore therebetween for receiving a portion of the shaft of the walking aid within the bore, attaching a top surface of a substantially planar base to the first end of the spring and affixing a traction sole to a bottom surface of the planar base, and inserting a portion of the free end of the shaft into the bore of the spring and retaining the shaft in attachment to the flexible foot by torsional force exerted by the spring on the inserted portion of the shaft and permitting angular adjustment of the entire planar base relative to the longitudinal axis of the shaft.

The above and other objects, advantages and novel features of this invention will be more fully understood from the following detailed description and the accompanying drawings.

DETAILED DESCRIPTION OF THE DRAWINGS

The invention will now be described, by way of example, with reference to the accompanying drawings in which.

DETAILED DESCRIPTION OF THE INVENTION

Figure 1:
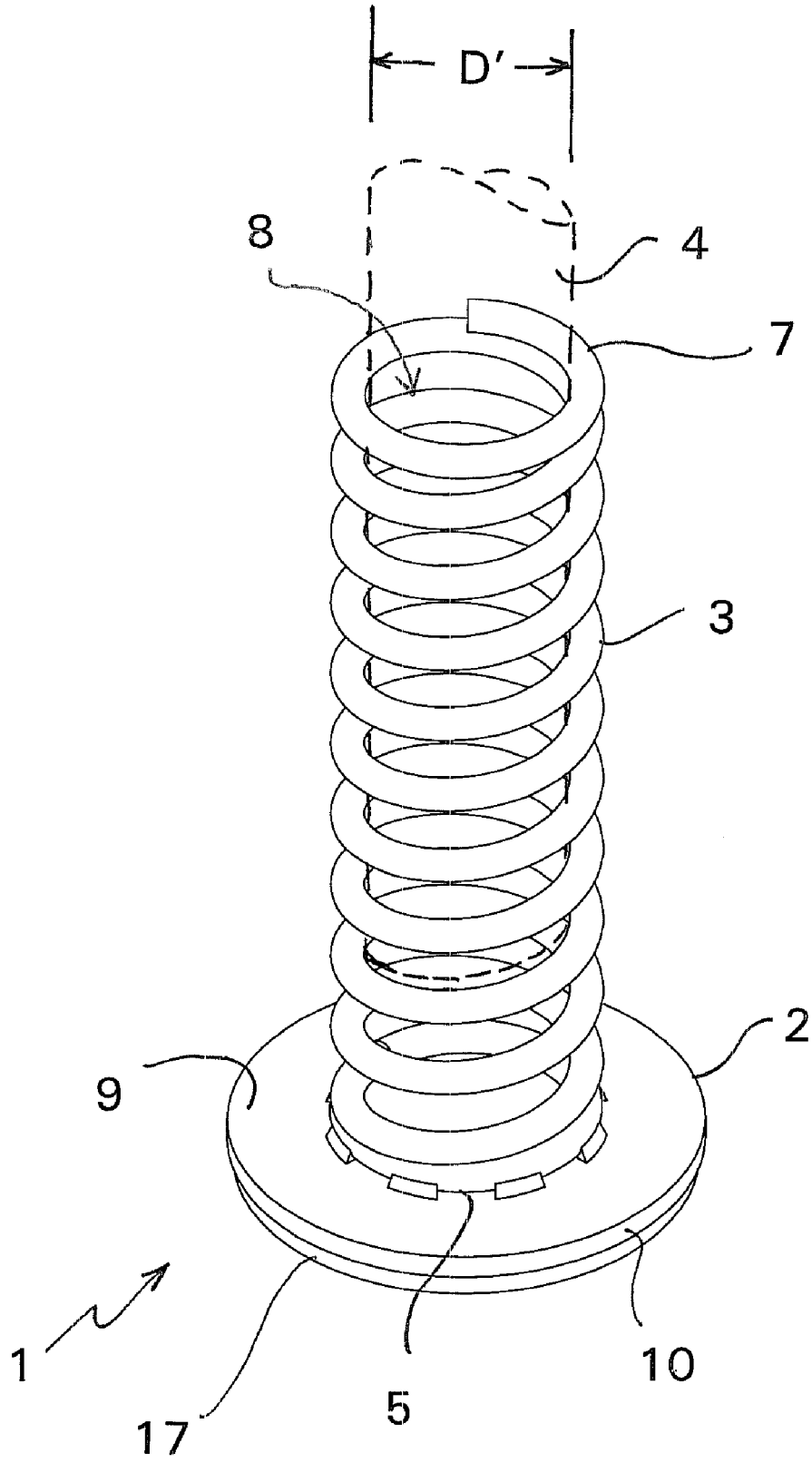
FIG. 1 is a perspective view of a flexible foot that may be added to a walking aid.
Figure 2:
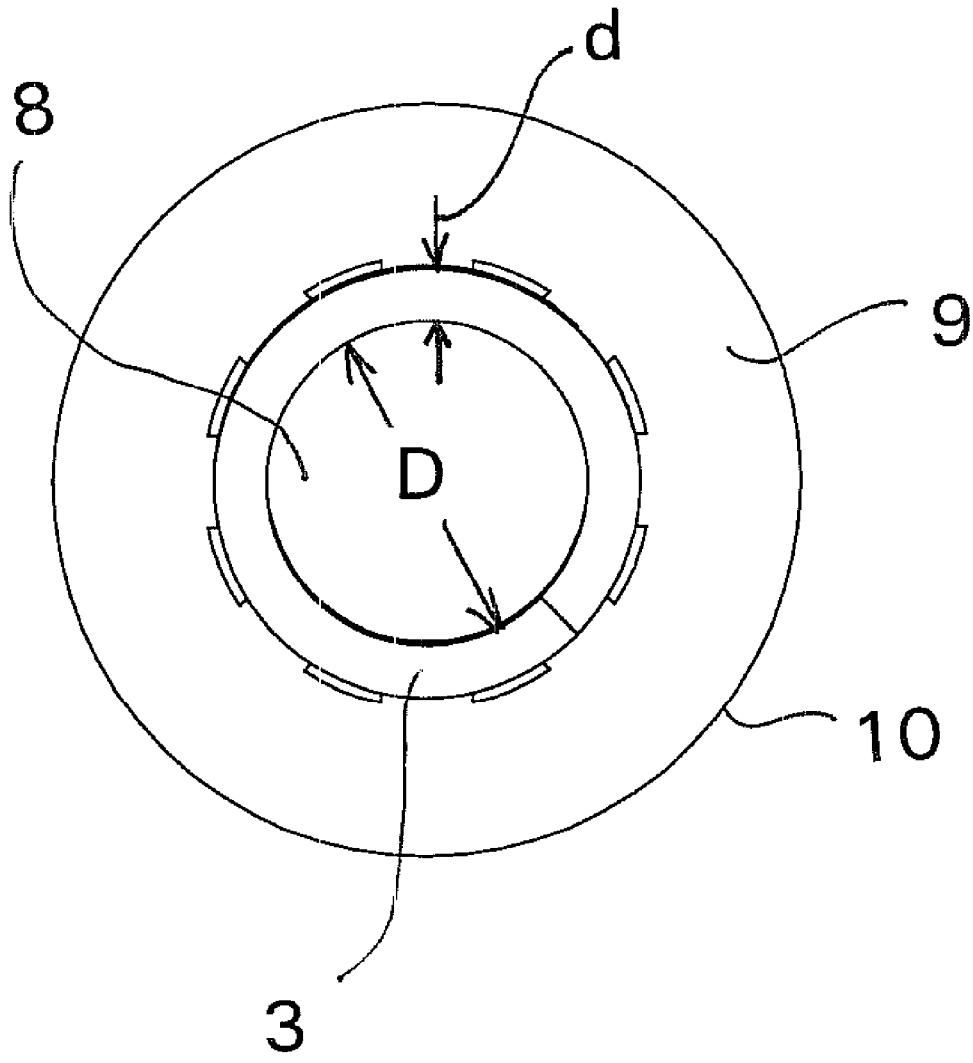
FIG. 2 is a top planar view of the flexible foot.
Figure 3:
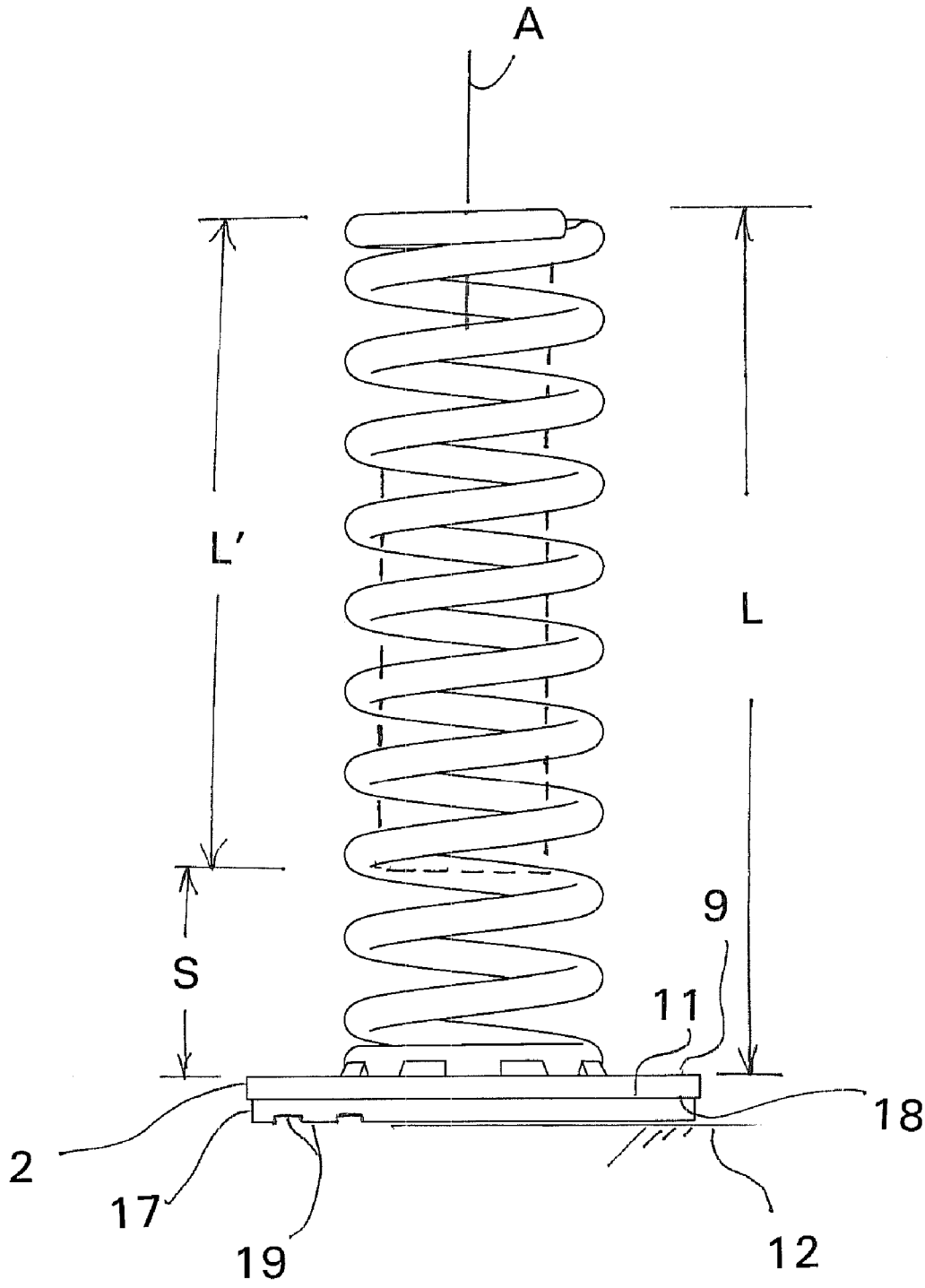
FIG. 3 is a side elevational view of the flexible foot.

Referring to FIGS. 1-3, a flexible foot 1 includes, in general, a base 2 attached to a flexible cylinder generally formed by a helical coil or spring 3 although other fittings, for example plastic or rubber tubes forming such a flexible cylinder, are contemplated as well. In this regard and without limitation thereto, for purposes of the description and the drawings, the flexible cylinder will be referred to as a spring 3. The spring 3 has a first end 5 and a second end 7 defining a bore 8 therebetween into which a shaft 4 of a cane or crutch is inserted. The spring 3 may be made most efficiently and economically fabricated from most any applicable stock material, steel being the most practical and economical, and the coil or spring stock material may be of any desired diameter d, cross-section and spring constant depending upon the prescribed load to be asserted on the spring 3.

The bore 8 defines a diameter D, which is also dependent upon the size or diameter D' of the cane or crutch with which the flexible foot 1 is to be used and the bore 8 may be formed by winding or forming the spring 3 or coil in a manner as known in the art with the appropriate diameter D so as to accommodate most any conventionally sized cane or crutch.

The base 2 is a generally planar plate or platform and has an outer circumferential edge 110, which may be defined or formed into most any shape, circular, oval, square, etc. In general, a circular shape is preferable as it presents no corners and has a constant radius which lends itself to a consistently applied and predictable contact area with a ground surface to facilitate movement. The base 2 has a planar top surface 9 to which the first end 5 of the spring 3 is attached, generally by welds in the case of steel, to secure the spring 3 to the base 2. A bottom surface 11 of the base 2 is provided for directly contacting the ground or a supporting surface 12 on which the user is walking. The bottom surface 11 may also have a gripping layer applied thereto, such as a friction generating rubber layer which may also include a tread design thereon.

The bore 8 and hence the spring 3 of the flexible foot 1 is defined about a vertical axis A. The vertical axis; A is defined as vertical in comparison to a horizontal support surface 12 for purposes of describing the present invention. It is to be appreciated that not all support surfaces are horizontal and that the axis A may not always be aligned directly vertical in the sense of gravitational pull. In any event, in a neutral and unflexed position, as shown in FIGS. 1-3, the axis A is perpendicularly aligned with the planar top surface 9 of the base 2. As a result, the second end 7 of the spring 3 is spaced a desired distance L from the top surface 9 of the base 2 so as to accept a desired length L' of the shaft 4 of the cane or crutch as will be described in further detail below. The distance L is in the range of about 1 to 6 inches and more preferably in the range of 2 to 5 inches.

The second end 7 of the spring 3 inherently defines an opening to the bore 8 of the spring 3 into which the shaft 4 of the cane or crutch 6 may be inserted. The desired length L' of the shaft 4 is frictionally or torsionally secured within the bore 8 and the inside diameter D of the bore is of adequate dimensions to tightly and securely fit around the outside diameter D' of the shaft of the cane or crutch 6. Such an inside diameter D of the spring 3 may be for instance manufactured slightly smaller than the diameter D' of the shaft 4 in order to securely frictionally and torsionally grip the shaft 4. With this arrangement, using only the natural torsion strength of the coil or spring 3 to tightly torsionally grip the shaft, the flexible foot 1 thus cannot simply slide or too easily come off, but may be removed from the shaft 4 of the cane with minimal effort and without extreme difficulty.

It is to be appreciated that the shaft 4 of the cane is generally inserted only the length L' and not the entire length L into the bore 8. This leaves a space S between a bottom end 16 of the shalt and the top surface of the base 2. This spacing S permits the relative angular, radial and axial movement of the base 2 without interference from the shaft. For example, where an axial force is applied along the shaft 4, the base 2 is permitted to move axially relative thereto in a cushioning effect to the axial force. Also, if the flexible foot 1 is in contact with the ground and the shaft 4 and the ground are inclined at an angle other than 90 degrees, than the spring 3 permits the bottom surface 11 of the base 2 to remain in parallel contact with the ground while the shaft 4 is inclined at the angle other than 90 degrees to the ground. The shaft 4 of the cane or crutch 6 is thus secured to the spring 3, but is not in any way affixed to the base 2 thus permitting the shaft 4 of the cane 6 to move axially and angularly relative to the base 2 without compromising adherence of the base 2 to the support or ground surface 12.

The shaft 4 of the cane or crutch may even abut the top surface 9 of the base 2 but, in any event, is not affixed or attached directly thereto. In this case, the bottom end of the shaft 4 can angularly move relative to the top surface 9 of the base 2 when there is relative angular displacement between the base 2 and the shaft 4. In this arrangement, there is little or no axial movement permitted between the base 2 and the shaft 4 since the shaft 4 abuts the base 2. The coil or spring 3 is, of course, structurally bendable meaning it will deflect with the movement of the shaft 4 in the bore E relative to the base 2 where the base 2 is frictionally engaged with a supporting surface 12. The spring 3 is also rigid enough to reposition the base 2 in a perpendicular manner relative to the shaft 4 without deformation when the base 2 is released from engagement with the supporting surface 12. The coil or spring 3 may also be designed in various lengths L, diameters or shapes to accommodate shafts of different thickness or dimensions. In general, most shafts will have a diameter D in the range of 0.5 of an inch to 3.0 inches and more particularly in the range of 1 to 2.0 inches and thus the range of bore diameters D would be substantially the same or even having a slightly smaller diameter in the range of about 0.4 of an inch to 2.9 inches and more particularly 0.8 to 1.9 inches to provide the requisite torsional gripping force to the shaft. It is also to be appreciated that with this arrangement the flexible foot 1 may be attached and retained on the shaft 4 solely by the torsion force of the spring 3 acting radially around the outside surface and diameter D' of the shaft 4.

In another embodiment, the base 2 is provided with an additional component attached or adhered to the bottom surface 11 of the base 2. A pliable traction sole 17, having a mating surface, is adhered to the bottom surface 11 of the base 2 and a ground friction surface 19 for directly contacting the supporting surface 12, may further increase the safety and security of the flexible foot 1. Where the base 2 is made of steel or a similar metal having a thickness that will not bend or substantially deform when the pressure and weight of a user leans with the assistance of a walking aid on the cane foot, the attached traction sole 17 is made of a rubber, plastic or other flexible material that provides frictional support for the pressure and weight of a user applied to the flexible foot 1. The traction sole 17 may have a tread pattern 19 to increase traction of the flexible foot 1 to better adhere to different types of support and ground surfaces and to adapt to both indoor and outdoor environments.

Figure 4:
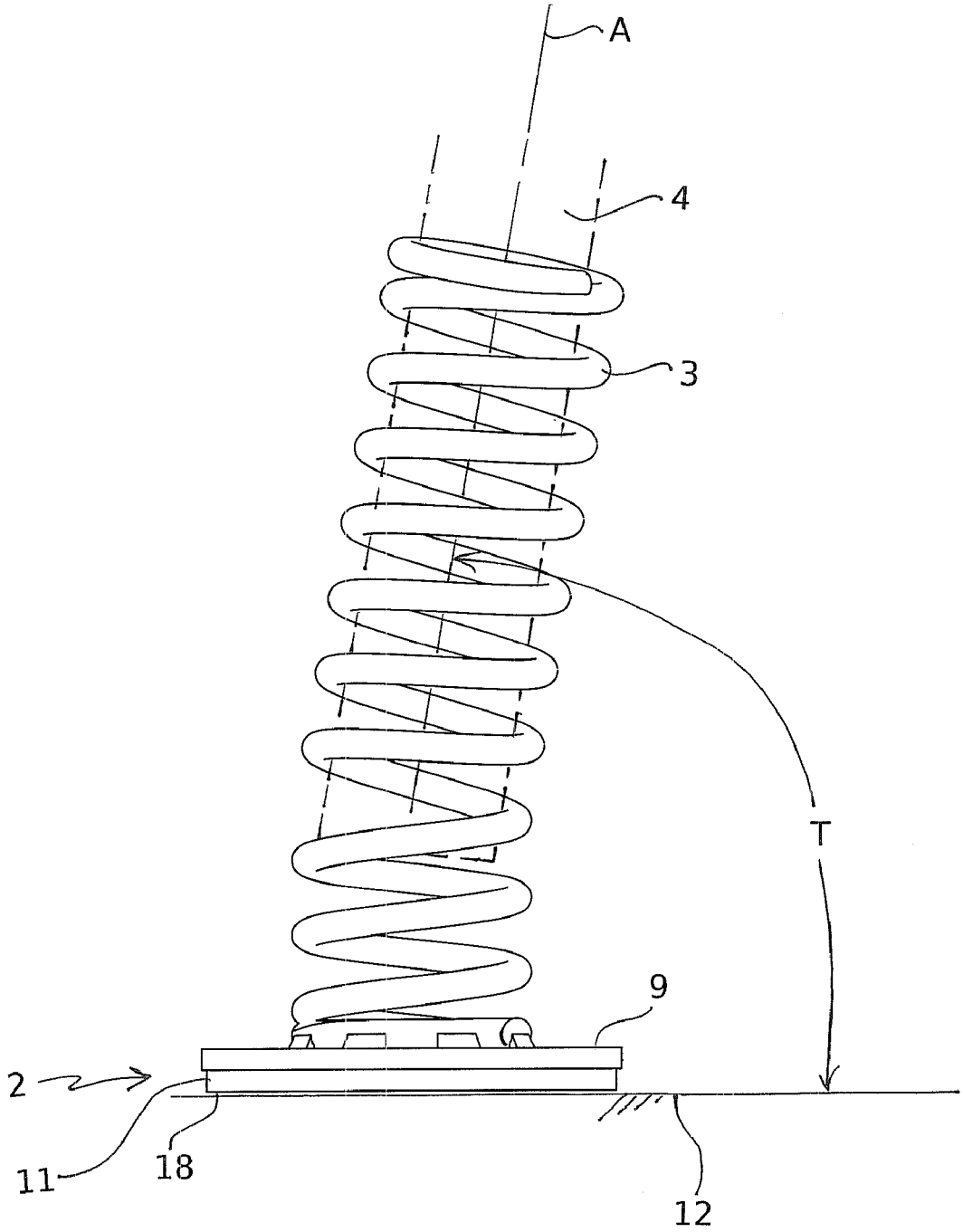
FIG. 4 is a side elevational view of the flexible foot in compression.

In use, the above described flexible foot 1 provides critical and important support to users in awkward and unsafe topographic conditions. For example as seen in FIG. 4, where a user cannot maintain the shaft 4 at a perpendicular angle relative to the base 2 and support surface 12, the shaft 4 is angled at some necessary angle T other than 90 degrees relative to the supporting surface 12. The flexible foot 1 therefore ensures that the entire bottom surface 11 and/or the entire traction sole surface 18 is engaged with the support surface 12 no matter what angle the user angles the shaft 4. This provides tremendous security and support to the user where they can be sure that the entire base 2 is fully engaged with the support surface 12 and the cane or crutch 6 will not slip or slide out from any position.

By way of a further example the flexible foot 1 also aids in allowing a person in a sitting position to rise to a standing position by moving and angling the shaft 4 and axis A relative to the supporting surface 12 in any necessary manner without moving or sliding the base 2 relative to the ground support surface 12. The ability to angle the shaft 4 relative to the base 2 and the supporting surface permits a user to support themselves enough to rise from the seated position while all the time the ground friction surface of the traction sole 17 is maintained in complete contact with the supporting surface 12.

Figure 5:
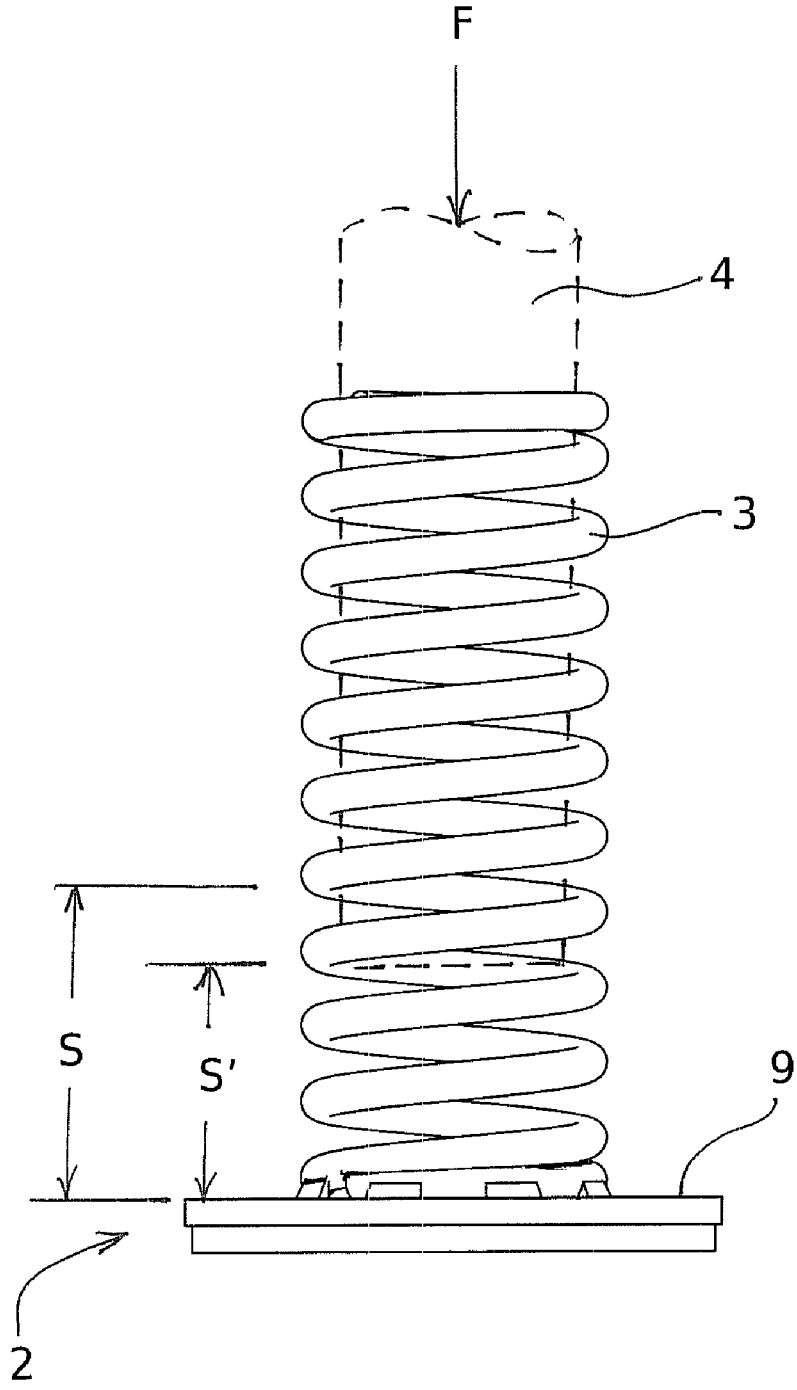
FIG. 5 is a side elevational view of the flexibility of the accessory tip when the spring is bent via the cane or crutch and an angle relative to the supporting surface.

Turning to FIG. 5, whether or not the shaft is angled, the spring 3 also permits compression of the flexible foot 1 to directly absorb a vertical and/or axial force F applied along the axis A of the shaft. As can be appreciated when the user applies their weight to the shaft 4 the spring 3 compresses and so the space S becomes smaller, i.e. compressed to a variable space S' depending on the magnitude of the force applied to the shaft 4. Thus, the spacing S and/or S' between the bottom end of the shaft 4 and the top surface 9 of the base 2 allows for such spring compression as well as for angulation of the shaft relative to the base 2. Clearly conditions can arise which would necessitate both an angulation as in FIG. 4 together with the compression as shown in FIG. 5. It is an important aspect of the present invention to permit both relative angulation of the shaft 4 and spring 3 relative to the base 2 and the supporting surface 12 as well as corresponding compression based on axially applied forces F.

Since certain changes may be made in the above described invention, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A flexible support (1) for a walking aid comprising:

a base (2) having a top surface (9) and a bottom surface (11);

a coil (3) having a first end (5) and a second end (7) defining a bore (8) for receiving a shaft (4) of the walking aid within the bore (8), the first end (5) of the coil (3) is attached directly to a top surface of the base (2) and the second end (7) of the coil (3) is spaced from the base (2) and defines an opening (13) where the shaft (4) of the walking aid is inserted in the bore (8) and the coil (3) with the shaft (4) is free to move angularly relative to the base (2);

a neutral position where a longitudinal axis A of the coil (3) is aligned perpendicular with the bottom surface (11) of the base (2), and a spring (3) biased position wherein the longitudinal axis A of the coil (3) is inclined at an angle relative to the bottom surface (11) of the base (2); and wherein the shaft of the walking aid is retained in attachment to the flexible support solely by torsion force exerted by the coil and a traction sole (17) made from a different material than the base (2) is attached to the bottom surface (11) of the base (2) to provide for enhanced frictional contact of the flexible support with a ground surface (19).

2. The flexible support (1) for a walking aid as set forth in claim 1 further comprising a tread design formed in the traction sole (17), the tread design comprising an engagement surface (18) having a plurality of discontinuous planar surfaces to facilitate traction of the flexible support on various ground surfaces.

3. The flexible support (1) for a walking aid as set forth in claim 2, wherein the spring (3) and the base (2) are fabricated from steel and the traction sole (17) is fabricated from a pliable material.

4. A walking aid for facilitating movement of a human user comprising:

a handle for manual articulation and operation of the walking aid by the user;

a shaft (4) extending along a longitudinal axis (A) between the handle and a free end of the shaft (4) generally positioned adjacent a supporting ground surface (12);

a flexible foot (1) attached to the free end of the shaft (4), the flexible foot (1) comprising;

a spring (3) having a first end (5) and a second end (7) defining a bore (8) therebetween for receiving a portion of the shaft (4) of the walking aid within the bore (8);

a substantially planar base (2) having a top surface (9) attached to the first end (5) of the spring (3) and a bottom surface (11) having a traction sole (17) affixed thereto, and wherein the shaft (4) is retained in attachment to the flexible foot (1) solely by torsional force exerted by the spring (3) on the received portion of the shaft (4) and the entire spring (3) with the shaft (4) is angularly moveable relative to the surface of the planar base (2).

5. The walking aid for facilitating movement of a human user as set forth in claim 4, wherein a diameter (D) of the bore (8) is slightly less than a diameter (D') of the shaft (4) of the walking aid to facilitate attachment and retention of the flexible foot (1) to the shaft (4).

6. The walking aid for facilitating movement of a human user as set forth in claim 5, further comprising a neutral position where the longitudinal axis (A) of the shaft (4) is aligned perpendicular with the substantially planar base (2), and a biased position wherein the longitudinal axis (A) of the shaft (4) is inclined at an angle other than 90 degrees relative to the entire substantially planar base (2).

7. The walking aid for facilitating movement of a human user as set forth in claim 6, wherein the traction sole (17) made from a different material than the base (2) and attached to the bottom surface (11) of the base (2) to provide for enhanced frictional contact of the flexible foot (1) with a ground surface (12).

8. The walking aid for facilitating movement of a human user as set forth in claim 7, further comprising a tread design formed in the traction sole (17), the tread design comprising an engagement surface (18) having a plurality discontinuous planar surfaces to facilitate traction of the flexible support (1) on various ground surfaces.

9. The walking aid for facilitating movement of a human user as set forth in claim 8, wherein the spring (3) and the base (2) are fabricated from steel and the traction sole (17) is fabricated from a pliable rubber material.

10. A method for facilitating movement of a human user comprising the steps of:

providing a handle for manual articulation and operation of the walking aid by the user;

forming a shaft (4) extending along a longitudinal axis (A) between the handle and a free end of the shaft (4) generally positioned adjacent a supporting ground surface (12);

attaching a flexible foot (1) to the free end of the shaft (4) according to the following steps;

providing a flexible cylinder (3) having a first end (5) and a second end (7) defining a bore (8) therebetween for receiving a portion of the shaft (4) of the walking aid within the bore (8);

attaching a top surface (9) of a substantially planar base (2) to the first end (5) of the flexible cylinder (3) and affixing a traction sole (17) to a bottom surface (11) of the planar base (2); and inserting a portion of the free end of the shaft (4) into the bore (8) of the flexible cylinder (3) and retaining the shaft (4) in attachment to the flexible foot (1) solely by torsional force exerted by the flexible cylinder (3) on the inserted portion of the shaft (4) and permitting angular adjustment of the longitudinal axis (A) of the shaft (4) relative to the entire planar base (2).

11. The method for facilitating movement of a human user as set forth in claim 10, further comprising the steps of forming a diameter (D) of the bore (8) slightly less than a diameter (D') of the shaft (4) of the walking aid to facilitate attachment and retention of the flexible foot (1) to the shaft (4).

12. The method for facilitating movement of a human user as set forth in claim 11, further comprising the steps of defining a neutral position where the longitudinal axis (A) of the shaft (4) is aligned perpendicular with the substantially planar base (2), and a biased position wherein the longitudinal axis (A) of the shaft (4) is inclined at an angle other than 90 degrees relative to the entire substantially planar base (2).

13. The method for facilitating movement of a human user as set forth in claim 12, further comprising the steps of fabricating the traction sole (17) from a different material than the substantially planar base (2) to provide for enhanced frictional contact of the flexible foot (1) with a ground surface (19).

* * * * *